US005133552A

United States Patent [19]

Feeney et al.

[11] Patent Number: 5,133,552

[45] Date of Patent: Jul. 28, 1992

[54] FLOATING YOKE PIECE FOR A RACKET

[75] Inventors: Brian P. Feeney, Enfield, Conn.; Richard Janes, Scottsdale, Ariz.

[73] Assignee: Lisco, Inc., Tampa, Fla.

[21] Appl. No.: 796,970

[22] Filed: Nov. 25, 1991

[51] Int. Cl.[5] ..... A63B 49/02

[52] U.S. Cl. ..... 273/73 G; 273/73 J

[58] Field of Search ..... 273/73 R, 73 A, 73 D, 273/73 E, 73 G, 73 J, 73 L

[56] References Cited

U.S. PATENT DOCUMENTS

| | | | |
|---|---|---|---|
| 1,122,159 | 12/1914 | Rickey | 273/73 G |
| 1,476,906 | 12/1923 | Santa Maria | 273/73 E |
| 1,912,942 | 6/1933 | Kleinman | 273/73 E |
| 4,265,450 | 5/1981 | Drake et al. | 273/73 G |
| 4,634,524 | 1/1987 | Yuhas et al. | 273/73 G |
| 4,828,260 | 5/1989 | Todd | 273/73 G X |
| 4,889,338 | 12/1989 | Keijiro | 273/73 G |
| 4,976,433 | 12/1990 | Pohleng et al. | 273/73 G X |
| 4,988,101 | 1/1991 | Soong | 273/73 G X |

FOREIGN PATENT DOCUMENTS

| | | | |
|---|---|---|---|
| 3715 | 9/1926 | Australia | 273/73 G |
| 2157181 | 10/1985 | United Kingdom | 273/73 E |
| 2218642 | 11/1989 | United Kingdom | 273/73 J |

*Primary Examiner*—Theatrice Brown
*Assistant Examiner*—William E. Stoll

[57] ABSTRACT

A tennis racket adapted to isolate and diminish shock and vibrations comprising a frame having a head end and a handle end and having recesses in the frame adjacent to an intermediate extent, the recesses being in a curved configuration; a yoke piece having a central extent and free ends, the free ends being curved in configuration essentially conforming to the recesses; and an elastomeric cushion positioned between the racket recesses and the yoke ends.

8 Claims, 4 Drawing Sheets

FLOATING YOKE PIECE FOR A RACKET

BACKGROUND OF THE INVENTION

1. Field of the Invention

The present invention relates to a floating yoke piece for a racket, and more particularly, to a tennis racket having a yoke which is held in position solely by the racket string pressure and which has an elastomeric cushion secured between the yoke ends and adjacent portions of the racket frame where contact therebetween is made.

2. Description of the Background Art

Tennis involves players on opposite sides of a net who employ rackets to strike a resilient ball back and forth over the net. The racket has one end with tensioned strings which contact the ball. The other end has a handle grasped by the user.

It is well recognized that modern, improved rackets add to a player's efficiency and to the enjoyment of tennis. It is also well recognized that further improvements to rackets are still possible for purposes such as abatement of shocks and vibration when striking the ball.

By way of illustration, the background art discloses many types of frames for supporting tensioned racket strings so as to abate shocks and vibrations. As an example of such wide variety of background art, note U.S. Pat. No. 4,204,681 to Hall which discloses a thermoplastic throat piece which is structurally integrated with a metallic racket frame by passing the strings through the holes formed in the throat piece. Limited torsional movement is allowed due to the materials and construction.

Note also U.S. Pat. No. 4,209,170 to Garber wherein there is disclosed a throat made of a resilient elastomeric material bolted between the oppositely curving portions of the frame. The throat completes the ovaloid shape of the head and provides the sole support for adjoining strings attached thereto.

Volkl, in U.S. Pat. No. 4,311,308, discloses a tennis racket with an insert installed in the throat portion. The insert is adapted to have secured thereto at least some of the strings. A central hinge allows for pivoting of the insert about a central vertical axis.

U.S. Pat. No. 4,634,124 to Yuhas discloses a racket with a throat piece in which vibrations produced by the impact of the ball on the strung hitting surface are dampened. This dampening is effected by an elastic dampening device secured by fasteners between the opposite sides of the throat piece and the otherwise normally abutting inside of each leg of the racket frame.

U.S. Pat. No. 4,783,072 to Haar discloses a throat of a racket with a tensioning device. The tensioning device comprises as least one pinion with a toothed periphery which threadedly engages with teeth on the end portion of a flexible member. By rotating the pinion, the flexible member will be moved so as to vary the tension in the strings.

In U.S. Pat. No. 4,828,259 to Davis, there is disclosed a throat ridge which spans the opposed leg of a frame member and which includes a pair of upper and lower bridge sections. Such sections extend generally transversely and are spaced apart longitudinally to define a cut out area therebetween. A piece of vibration absorbing material is positioned between the upper and lower bridge sections.

U.S. Pat. No. 4,828,260 to Todd discloses a tennis racket with a resilient insert which is disposed within a radially disposed gap which extends completely through the racket head between the two arms of the yoke. The resilient insert is keyed to fit closely within the gap of a racket handle. It is secured in place by a base plate which overlies the confronting ends of the head formed by the gap.

Lastly, U.S. Pat. No. 4,976,433 to Pohlenz discloses a gas spring incorporated into a tennis racket in the throat area. The gas spring is coupled with some of the strings so as to maintain a predetermined tension within the strings irrespective of a possible elongation of the strings during operation.

As can be readily understood, the background art discloses a wide variety of tennis rackets designed for shock and vibration abatement through a wide variety of mechanisms. Such rackets are fabricated of a wide variety of materials, synthetic and natural, and formed by a wide variety of processes. No background art, however, discloses, teaches or suggests a tennis racket with a floating yoke piece that is not directly attached to the rest of the racket frame except by the strings and which includes a cushioning member in the area of the contact between the yoke and frame for absorbing and abating shocks and vibrations.

As illustrated by the background art, efforts are continuously being made to improve tennis rackets. No prior reference, however, suggest the present inventive combination of component elements arranged and configured as disclosed herein. Prior rackets do not provide the benefits attendant with the present invention. The present invention achieves its purposes, objects and advantages over the prior art through a new, useful and unobvious combination of component elements, through the use of a minimum number of functioning parts, through the utilization of readily available materials and conventional components, and with no appreciable increase in costs.

It is therefore an object of the present invention to provide a tennis racket frame adapted to isolate and diminish shock and vibrations, the frame having a head end and a handle end with recesses adjacent to an intermediate extent of the frame, the recesses being in a curved configuration; a yoke piece having a central extent and free ends, the free ends being in a curved configuration essentially conforming to the recesses; and cushioning means positioned between the racket recesses and the yoke ends.

It is a further object of the invention to isolate and diminish shocks and vibrations in the tennis racket through the use of a floating yoke.

It is a further object of the present invention to couple the yoke of a tennis racket to the remainder of the frame with cushioning components therebetween for abating the negative effects of shocks and vibrations.

It is a further object of the invention to couple a yoke piece to the remainder of the frame by string tension only.

Lastly, it is an object of the present invention to provide superior playing performance and greater comfort to tennis players.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention may be incorporated into a tennis racket having a frame adapted to isolate and diminish shock and vibrations, the frame having a head end and a handle end with recesses adjacent to an intermediate extent of the frame, the recesses being in a curved configuration; a yoke piece having a central extent and free ends, the free ends being in a curved configuration essentially conforming to the recesses; and cushioning means positioned between the racket recesses and the yoke ends.

The free ends of the yoke are curved in both the plane of the strings and the plane perpendicular thereto. The curve of the yoke ends in the plane of the strings has a smaller radius of curvature than the radius of curvature in the plane perpendicular thereto. The recesses of the frame are curved in correspondence to the curves of the free ends of the yoke.

The invention may also be incorporated into a tennis racket adapted to abate shock and vibrations comprising a frame having a head end and a handle end and having recesses in the frame adjacent to an intermediate extent, the recesses being in a curved configuration; a yoke piece having a central extent and free ends, the free ends being curved in configuration essentially conforming to the recesses; strings joining the yoke piece to the frame as the only means of coupling therebetween; and cushion means positioned between the racket recesses and the throat ends.

The racket further includes a soft grommet strip with a Shore D hardness of between about 52 and 62 and a soft pallet with a Shore A hardness of between about 50 and 80 and the cushion means is a soft PVC.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
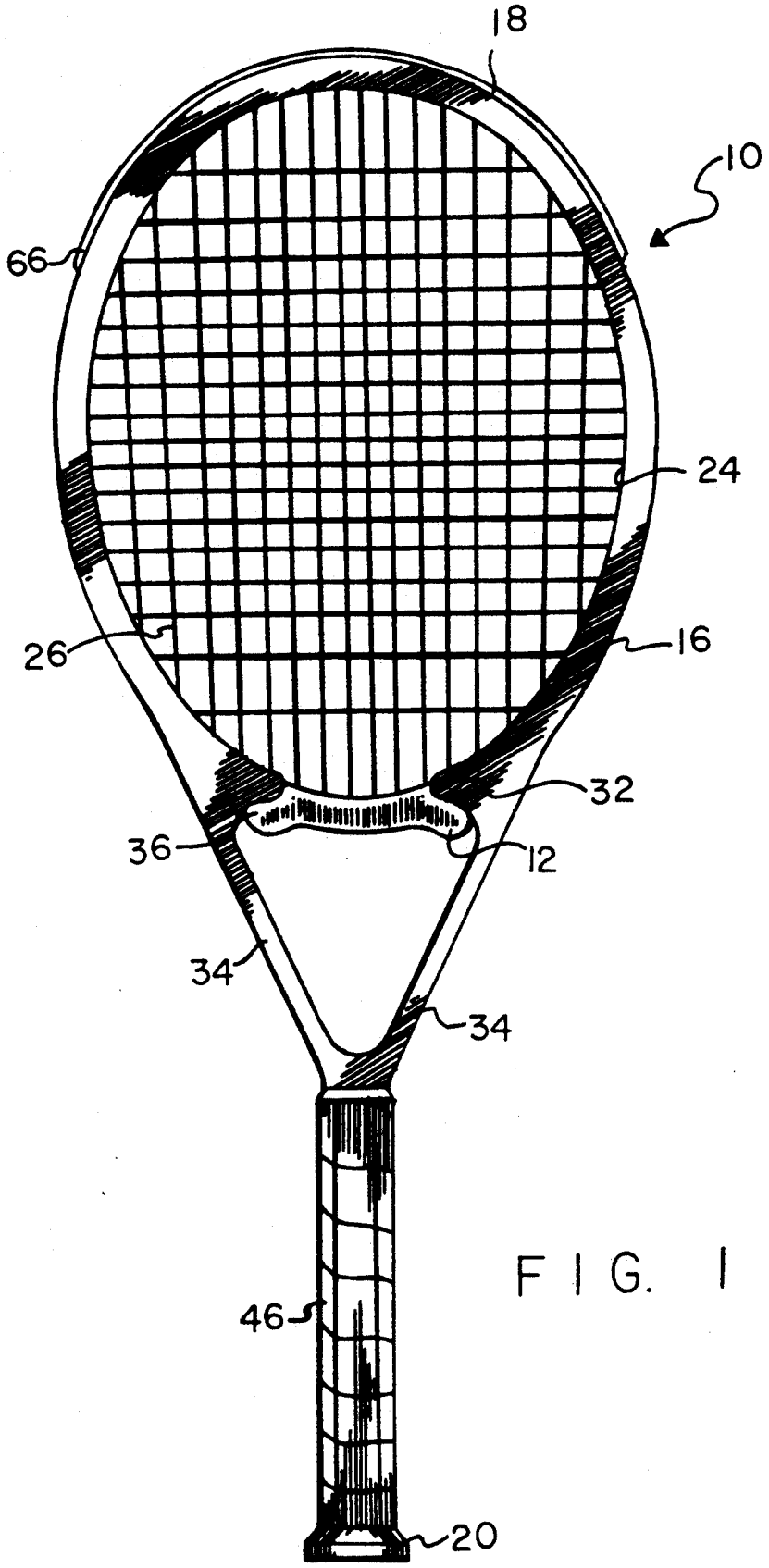
FIG. 1 is a plan view of the tennis racket utilizing the floating pallet of the present invention.
Figure 2:
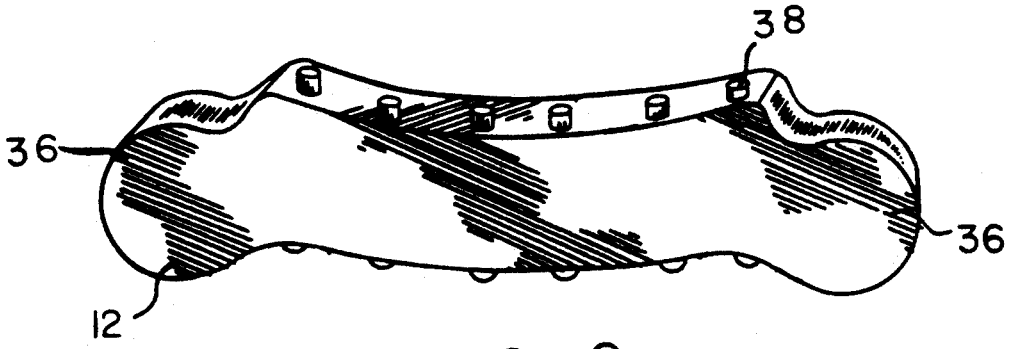
FIG. 2 is a perspective illustration of the floating yoke constructed in accordance with the principles of the present invention.
Figure 3:
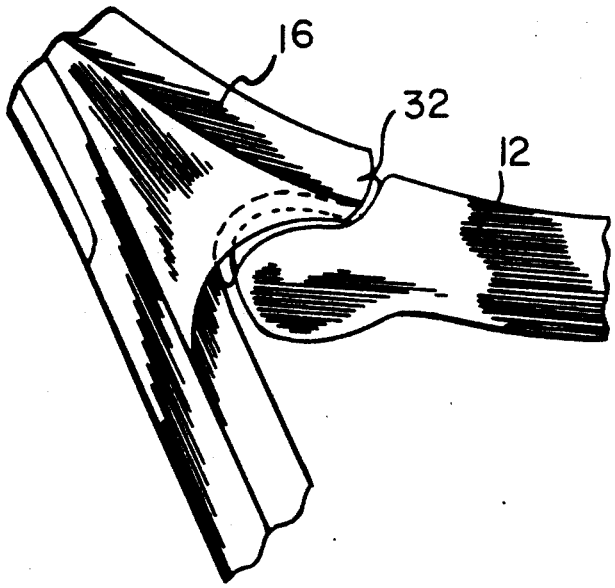
FIG. 3 is a perspective illustration of the floating yoke showing in cooperable relationship with the frame of the racket.

Shown in FIG. 1 is what appears to be a conventional tennis racket 10 but which is provided with the improved, floating yoke piece 12 of the present invention. The tennis racket 10 is fabricated of a frame 16 having a head end 18 and a handle end 20. Adjacent the head end 18 is an opening 24 across which strings 26 are secured under tension to constitute the hitting surface. Either side of the strings may be utilized as the hitting surface.

The frame 16 of the tennis racket 10 is essentially conventional in most regards. It is, however, provided with recesses 30 on the interior surfaces adjacent to a central extent of the frame length. The central extent where the recesses 30 are provided is adjacent to the lowermost portion of the head. The recesses 30 are formed facing each other on downwardly and inwardly facing projections 32 of the frame. This location is immediately above the beams 34 and immediately beneath the strings 26.

Figure 4:
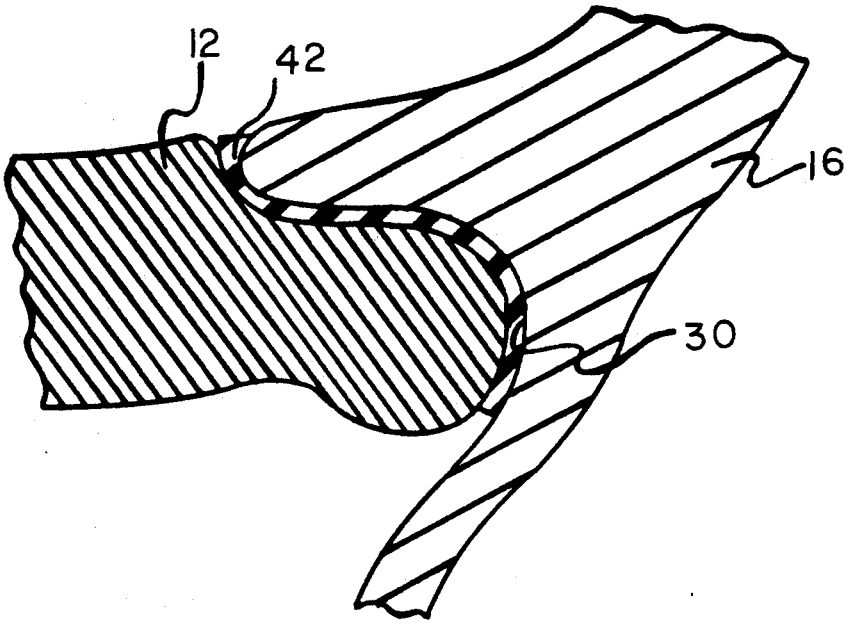
FIG. 4 is a sectional view of one end of the floating yoke and an associated part of the frame taken centrally through the racket parallel with the strings.
Figure 5:
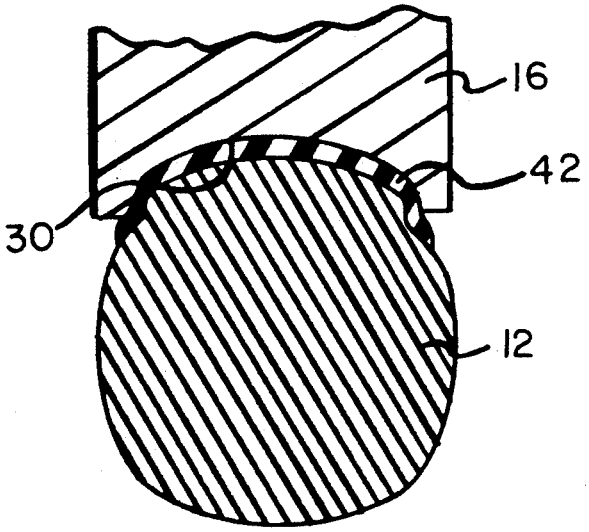
FIG. 5 is a sectional view similar to FIG. 4 taken perpendicular to the strings.
Figure 6:
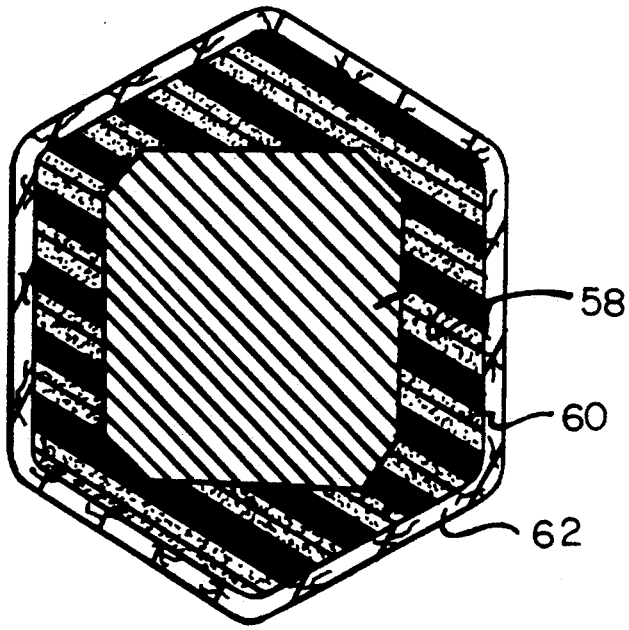
FIGS. 6 and 7 are sectional views of the handle of the racket shown in FIG. 1.
Figure 7:
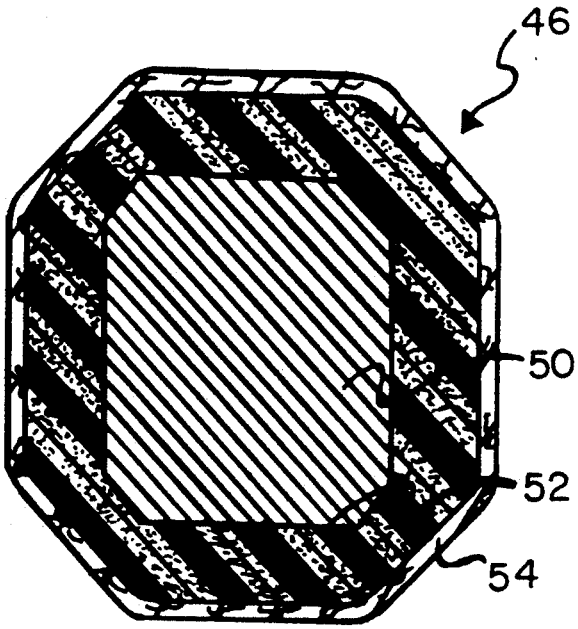

The recesses 30 are curved in an arcuate manner about an axis of curvature when viewed in a sectional view in the plane of the strings. Note FIG. 4. When viewed in a plane perpendicular to the strings, the recesses are also curved and about an axis of curvature. Note FIG. 5. The axis of curvature of the section of the recesses has a radius of curvature which is greater in the plane perpendicular to the strings than it is in the plane parallel with the strings. A concave spheroid surface is thus defined.

Between the projections 32 and recesses 30 is an opening in the frame for the receipt of the yoke piece 12. In the preferred embodiment, there are 16 vertical or main strings 26. The central six strings are located in alignment with the opening for being received and supported by the yoke piece. The ten outermost main strings, five on each side, are adapted to be secured to the main portion of the frame. As a result, 6/16 of the main strings of the racket are supported by the yoke piece, this constitutes $\frac{3}{8}$ or $37\frac{1}{2}$ percent of the width of the racket as constituting the strings supported by the yoke piece. Most hits by the racket are made with such central main strings.

The yoke piece 12 itself has a central extent with a generally oval cross section corresponding in size and shape to the generally oval shape of the majority of the frame in the head and throat areas. Its central axis is slightly curved through the majority of its extent. This effects a smooth continuation of the extent of the frame throughout the entire head.

The ends 36 of the yoke piece 12 are enlarged for forming spheroid or ball like members for being received in the recesses. Each of the ends of the throat piece are curved in the plane of the strings to correspond to the curvature of the recesses in such plane. In a plane perpendicular to the strings, the surface of the ends of the throat pieces are also curved, again corresponding to the curvature of the recess in such plane. Note FIGS. 4 and 5.

As can be seen in the Figures, a plurality of apertures are formed through the yoke piece interiorly of the ends for the receipt of barrels 38, grommets for the receipt of the strings. Six such holes and grommets are provided in the preferred embodiment. Similar apertures extend through the frame in the head are for string support in the conventional manner.

Located between the ends of the yoke piece 12 and the interior surfaces of the recesses 30 are strips 42 of a cushion material glued or otherwise adhered to the recesses of the frame. The cushion or resilient material 42 has an exterior surface of size and shape to be received by, and conformed to, the recesses 30 of the frame. The interior surface of the cushion material is similarly sized and shaped to receive the exterior surfaces of the ends of the throat piece. Its longitudinal edges are received in circumferential notches in the circumferential edges of the free ends of the yoke. As such, the thickness of the cushion material is essentially the same throughout its entire extent. The entire extent of each cushion member is such as to contact the entire surface of the recess 30 as well as the entire surface of the ends 36 of the yoke piece 12 so that there is no physical contact between the yoke piece and the frame recesses except through the cushion material. This maximizes the shock and vibration dampening capabilities of the system.

The floating yoke system as described herein is designed to isolate and diminish the vibration and shock to a player which is normally generated during the impact of a tennis ball being hit by a tennis racket. The basic concepts herein can also be readily employed in other strung rackets, including squash, racquetball and badminton.

The goals of isolating and diminishing shock and vibration is achieved in several ways by the floating yoke design. The most obvious part of the design involves the isolation of the yoke from the remainder of the frame. The yoke is attached to the frame only via the centermost main strings and is effectively "floating" on the soft rubber cushions between the yoke and the remainder of the frame. Any ball that hits any of these main strings, normally most hit balls, will cause the compression of the cushions. This compression of the cushions will effectively be the same as if these main strings had more give or resiliency, or were strung looser. The advantage is that string slippage between main vertical and cross horizontal strings can be reduced because the strings can be strung more tightly. Excessive slippage causes energy loss and string wear through friction. Excessively tight stringing may accellerate string breakage. By the present invention, the tighter strings still have the "feel" of looser strings. As the string unloads after the striking of a ball, there will be a similar unloading of the cushions in the yoke area. This effectively increases the trampoline effect and power of the racket. Excessive trampolining may be undesirable due to lack of control. The racket of the present invention allows for the benefits of trampolining without the loss of control. Since the effect of the yoke is to imitate the performance of looser strings without some of the detrimental aspects of such looser strings, the hit ball will stay on the string for a longer time. This is significant in that the energy of the impact of the ball against the strings is defined by the amplitude of the shocks multiplied by the period of the shock. The amplitude of the shock is really the problem part of the shock that causes "tennis elbow". In the floating yoke design, since the total energy will be the same and the time will be lengthened, the amplitude of the shock is thereby decreased.

A second less obvious beneficial result of the floating yoke is that the yoke provides a counter acting force to that of the impacting ball. At the moment of impact of the ball, the racket will recoil. Since the yoke, however, has not been directly acted upon by any forces, it will tend to continue in a forward motion. This forward motion of the yoke involves energy that will tend to act in opposition of that of the ball impact. The resultant shock is thereby reduced. Over time the yoke will also tend to vibrate out of phase with respect to the frame and help to dampen the vibration of the frame. This overall effect is the same as the theory behind the string vibration dampeners that are very popular in the industry. But since the mass of the yoke, about 30 grams, is about ten times that of a typical dampener, about 2–3 grams, and the energy dissipated is directly related to the mass, the effect of the free floating yoke will be proportionately larger.

On shots that hit off center that do not come into contact with the six center most main strings, the second effect above will still be applicable. On these same shots there is another advantage to the floating yoke. Because the two throat beams on opposing sides of the frame are not locked together by the rigid yoke piece, and no stress riser is present, the beams will more easily flex and absorb the impact and torsion felt by the player.

The principle part of the present invention is the yoke piece 12 of the frame 16 of the racket 10 which is held in position solely by the main strings of the head. This results in superior play. It has been found, however, that shocks and vibrations are further abated in the racket through the incorporation of a soft pallet and a soft grommet strip.

Located at the handle end 20 is the handle 46 for being gripped by the user of the racket 10. As is conventional in the art, the handle 12 is provided with a plurality of flat sections extending longitudinally along the handle. Edges separate the flat section. In the preferred embodiment, the handle 46 takes an octagonal cross-sectional configuration with eight flat sections and eight edges. A spiral wound layer 54, as of leather or the like, covers the handle pallet 54 over a rigid core 50 for improved grippability.

In an alternate embodiment of the invention, the grip is formed with six sides. In this embodiment, the central rigid core 58 is formed as an extension of the frame. An intermediate soft pallet 60 is employed. The pallet is overwrapped with a grip material 62 as of leather or the like. Further details of construction of the soft pallet can be seen in U.S. patent application Ser. No. 07/422,722 filed Oct. 10, 1989. Further details of construction of the six sided grip can be had by reference to U.S. patent application Ser. No. 07/676,771 filed Mar. 27, 1991. The subject matter of such two patent applications is incorporated by reference herein.

Most handles are of an excessively hard material, with a Shore D hardness of 40 to 80 plus, whereby forces generated by striking a ball would generate shocks and vibrations which were transferred to the user thereby causing discomfort. Over the course of a game, set or match, such repeated vibrations and shocks would be fatiguing to the user resulting in a continuing decrease in the user's efficiency of play.

The present invention is preferably utilized in association with an elastomeric polymeric material as the handle pallet, preferably a urethane, molded to the frame at the butt end or handle end. The pallet handle has been found to function with frames, not only of graphite reinforced epoxy, but also of other materials including aluminum and mixtures of graphite reinforced epoxy such as graphite/glass, graphite/Kevlar, graphite/-ceramic or other similar materials utilized as reinforcement fibers in an epoxy matrix. The term "graphite" racket as used herein is intended to include rackets of one-hundred percent (100%) graphite as well as rackets wherein other materials are provided so long as graphite represents a significant amount of the constituent material. The one-hundred percent (100%) graphite racket is preferred.

The hardness of this preferred handle pallet material has an added benefit beyond the vibration and shock abatement. Specifically, when such a handle is gripped by a user in a normal fashion during the play of tennis, the user will deform the handle material slightly. Such deformation, however, has been found to be insufficient to effectively eliminate the flat sections and edges molded into the cross-section of the handle. Such flat sections and edges may still be "felt" by the user. As a result, without looking at the racket and its strings, the user will be able to "feel" the flat sections and edges and, therefore, be able to index the hitting surface of the racket to a proper angular orientation with respect to the ball to be struck.

The hardness of the pallet is between 50 and 80 on a Shore A hardness scale. It has been found that for the traditional player who is used to well defined edges due to many years of play relying on the indexing which prior hard pallets provided, a Shore A hardness of between 60 and 80 is preferred for increased feel for indexing. Specifically, a Shore A hardness of between 60 and 70 is more preferred, most preferably about 65. For the players who still rely on indexing but are not as tied to the feel of past rackets with hard pallets, a Shore A hardness of between about 50 to 60 is preferred. This will allow for good indexing but minimizes the effects of shock and vibration to the player during use. The pallet with the Shore A hardness of between about 50 and 60 is also preferred by teaching pros where they play day in and day out. A Shore A hardness range of between 52 and 58 is more preferred, most preferably about 55.

A further feature of the racket of the present invention is the soft grommet strip 66 which further absorbs and abates shocks as well as vibrations before they are transmitted from the strings to the bow to the handle to the player. The shape of the grommet strip is essentially conventional. It extends over the top of the bow on the radially exterior edge thereof and encompasses the majority of the extent of the bow opening. It confirms in cross-sectional shape to a recess in the exterior edge of the bow and extends to a limited distance radially outwardly therefrom. The portion of the grommet strip extending across the top of the bow has enlarged axially extending portions functioning as a bumper strip to preclude inadvertent scratching of the bow in this region. String-receiving barrels, fabricated as extensions of the bumper strips and with radial holes extending therethrough, function as grommets and are preferably formed directly with the grommet strip. As such, the hardness and other physical characteristics of the grommets and bumper strips are matched. These barrels extend through aligned radial holes in the bow and function to support the strings.

The soft grommet strip is in the order of 57 Shore D scale plus or minus 5, i.e., from about between 52 and 62. In this regard, prior art grommet strips were manufactured from various thermoplastic materials but they never had a Shore D hardness of about 57 in order to achieve the desired results of this invention.

A preferred grommet strip material is pelletized thermoplastic polyurethane-polycarbonate blend. Texin 3203, a commercial product of Mobay Corporation of Pittsburgh, Pa. has been found to be highly suitable. Such resin was supplemented in the conventional manner with appropriate minor quantities of ultraviolet (UV) stabilizers and antioxidants to improve life and performance. Another suitable material is Ryslan "Nylon II" of Rilsan Industrial Inc., Birdsboro, Pa., with plasticisors "P 40" in order to attain Shore D 57 hardness.

In selecting a material with the desired Shore hardness for a grommet strip and grommets, the material cannot be so soft that the strings bite through the grommet strip when it is put under pressure in the racket. Tensions are generated on rackets from 40 to 80 pounds. Eighty pounds is an upper limit. It has been found that the hardness range mentioned above from 52 to 62 is hard enough to keep the strings from biting or tugging through the grommet strip at all normal stringing tension. It is intended to create a Shore hardness in the grommet strip that is just soft enough to allow the strings to slightly bite into without cutting through excessively to thereby give excellent shock and vibrational dampening properties.

The composition for the grommet strip, as mentioned above, is also advantageous in that is has an excellent memory. When a racket is strung, the grommet strip is deformed. The excellent memory is advantageous in that when the strings are cut and removed, the grommet strip tends to go back to its original shape and, hence, can be removed. If a grommet strip does not go back to its original shape, if, for example, the flared ends remain flared, in many cases the grommet strip can only be removed with great difficulty.

Further, the grommet strip as mentioned above has high tear strength. High tear strengths are important in that when an individual is attempting to remove the grommet strips for restringing, it is important that the grommet strip does not tear apart, thereby subjecting the strings to the sharp edges of the frame holes, as well as the separation of the grommet barrels during removal of the strings from the barrels. The removal of prior art type grommet strip components from the racket frame was, and still is, very difficult and expensive.

Further details of construction of the grommet strip may be had by reference to U.S. patent application Ser. No. 07,463,766 filed Jan. 12, 1990. The subject matter of such patent application is incorporated herein by reference.

The preferred material for the frame is preferably 100% graphite, or a graphite glass combination. Nylon, Nylon 6/6 or Nylon 6, reinforced with a minimum of 25% chopped graphite fibers, is preferred for the yoke. Soft PVC is preferred for the cushions for performance and cost reasons. Natural rubber, Kraton or other soft thermoplastic material with a Shore A hardness of about 80–90 is also acceptable. The pallet is preferably Sensathane while the bumper and grommet materials is preferably Rilsan Nylon 11.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now what is claimed is: that the invention has been described,

1. A tennis racket frame adapted to isolate and diminish shock and vibrations, the frame having a head end and a handle end with recesses adjacent to an intermediate extent of the frame, the recesses being in a curved configuration; a yoke piece having a central extent and free ends, the free ends being in a curved configuration essentially conforming to the recesses; and cushioning means positioned between the racket recesses and the yoke ends.

2. The frame as set forth in claim 1 wherein the free ends of the yoke are curved in both the plane of the strings and the plane perpendicular thereto.

3. The frame as set forth in claim 2 wherein the curve of the yoke ends in the plane of the strings has a smaller radius of curvature than the radius of curvature in the plane perpendicular thereto.

4. The frame as set forth in claim 3 wherein the recesses of the frame are curved in correspondence to the curves of the free ends of the yoke.

5. A tennis racket adapted to abate shock and vibrations comprising:

a frame having a head end and a handle end and having recesses in the frame adjacent to an intermediate extent, the recesses being in a curved configuration;

a yoke piece having a central extent and free ends, the free ends being curved in configuration essentially conforming to the recesses;

strings joining the yoke piece to the frame as the only means of coupling therebetween; and cushion means positioned between the racket recesses and the throat ends.

6. The racket as set forth in claim 5 and further including a soft grommet strip with a Shore D hardness of between about 52 and 62.

7. The racket as set forth in claim 5 and further including a soft pallet with a Shore A hardness of between about 50 and 80.

8. The racket as set forth in claim 5 wherein the cushion means is a soft PVC.

* * * * *